United States Patent [19]

McFall

[11] 4,181,247

[45] Jan. 1, 1980

[54] YARN-HANDLING DEVICE

[75] Inventor: Andrew J. McFall, Waynesboro, Va.

[73] Assignee: E. I. Du Pont de Nemours and Company, Wilmington, Del.

[21] Appl. No.: 873,678

[22] Filed: Jan. 30, 1978

[51] Int. Cl.[2] ..... B65H 17/32

[52] U.S. Cl. ..... 226/97; 28/255; 28/273

[58] Field of Search ..... 226/97; 181/259, 262-263, 181/220; 28/271-276, 255; 57/34.5, 34 B, 304, 305, 350

[56] References Cited

U.S. PATENT DOCUMENTS

| | | | |
|---|---|---|---|
| 2,233,327 | 2/1941 | Sauer | 181/262 |
| 2,971,243 | 2/1961 | Burns | 226/97 |
| 3,156,395 | 11/1964 | Ashby et al. | 226/97 |
| 3,669,328 | 6/1972 | Castelli | 226/97 |

FOREIGN PATENT DOCUMENTS

| | | | |
|---|---|---|---|
| 1225020 | 3/1971 | United Kingdom | 28/273 |

*Primary Examiner*—H. Grant Skaggs

[57] ABSTRACT

A yarn-handling device is provided which operates in accordance with the principle of aspiration and exhibits improved efficiency and less noise. The device, which is suitable for string-up, doffing and stripping operations, has a yarn inlet tube and a yarn outlet tube located in series on the same longitudinal axis. The outer surface of the outlet end of the yarn inlet tube is frusto-conical, having a taper angle of about 25° with the axis and containing a plurality of flutes, each at an angle of about 30° with the slant height of the frusto-conical surface. The inlet to the yarn outlet tube is preceded by another frusto-conical surface which is coaxial with the first mentioned frusto-conical surface and spaced therefrom in almost nested relationship to form an annular passage for pressurized air to flow into the yarn outlet tube, aspirate yarn into the yarn inlet tube and carry the yarn through the tubes.

7 Claims, 9 Drawing Figures

YARN-HANDLING DEVICE

TECHNICAL FIELD

This invention concerns a yarn-handling device that is especially useful for stripping, doffing and stringing-up operations.

BACKGROUND OF THE INVENTION

Yarn-handling devices, typically called "sucker-guns" when used for the aforesaid operations, employ a flow of air to aspirate yarn through a suction nozzle. This aspiration effect enables the device to guide yarn through a machine for operations such as spinning and drawing (string-up), transfer from one windup bobbin to another (doffing) or removal of undesirable yarn from the surface of a bobbin (stripping). Usually, the aspirated yarn is disposed of as waste, or is recycled.

Various devices have been available for the aforementioned purposes. Typically, such a device has a housing which includes an interior chamber, an inlet for supplying pressurized air to the chamber, a yarn inlet tube into which yarn is aspirated and a yarn outlet tube through which the aspirated yarn is carried by the flow of air out of the device. The yarn inlet and yarn outlet tubes are both located in series on the same longitudinal axis of the device. The structure of the device is arranged so that air leaving the interior chamber enters the yarn outlet tube in a manner that creates suction in the yarn inlet tube, thereby obtaining the aspiration effect.

Although the above-described yarn-handling devices have operated satisfactorily in the past, there still exists a need for reducing the air consumption and noise associated with operation of the devices. For example, the noise level of the prior-art devices can sometimes exceed the 90-db level, above which ear protection is needed. Although simply reducing the air consumption in these devices can reduce the noise level somewhat, such reductions are usually accompanied by an adverse reduction in the rate of yarn take-up and the tension on the aspirated yarn, which in turn adversely affects an operator's ability to perform efficient stripping, doffing or string-up operations.

DISCLOSURE

SUMMARY OF THE INVENTION

To satisfy the aforementioned needs, the present invention provides an improved yarn-handling device of the type which comprises a housing having an interior chamber, an inlet for supplying pressurized air to the chamber, a yarn inlet tube having an inlet end, an internal passage and an outlet end, a yarn outlet tube having an inlet end, an internal passage and an outlet end, both tubes being located in series on the same longitudinal axis of the device, and structure defining an exit from the chamber for directing air from the chamber into the inlet end of the outlet tube and in so doing creating a suction effect for aspirating yarn into and through the inlet tube and then into, through and out of the outlet tube with the flow of air. The improvement in the yarn-handling device of the present invention comprises the structure including a first frusto-conical surface forming the exit from the chamber, a second frusto-conical surface located on the outer surface of the outlet end of the yarn inlet tube, the first and second frusto-conical surfaces being spaced from one another in coaxial, almost nested relationship to form an annular passage through which air flows from the chamber into the inlet end of the yarn outlet tube, the angle of taper of said frusto-conical surfaces being between 22° and 32° to the longitudinal axis, the second-mentioned frusto-conical surface having a slant height and a plurality of flutes evenly spaced around the surface, the flutes being inclined at an angle of 20° to 40° to the slant height and the internal passage of the outlet tube being from 10 to 30 cm long and the passage tapering outwardly in the downstream direction at an angle of from 0°15′ to 0°50′, as measured from the longitudinal axis.

DETAILED DESCRIPTION OF THE INVENTION

Figure 1:
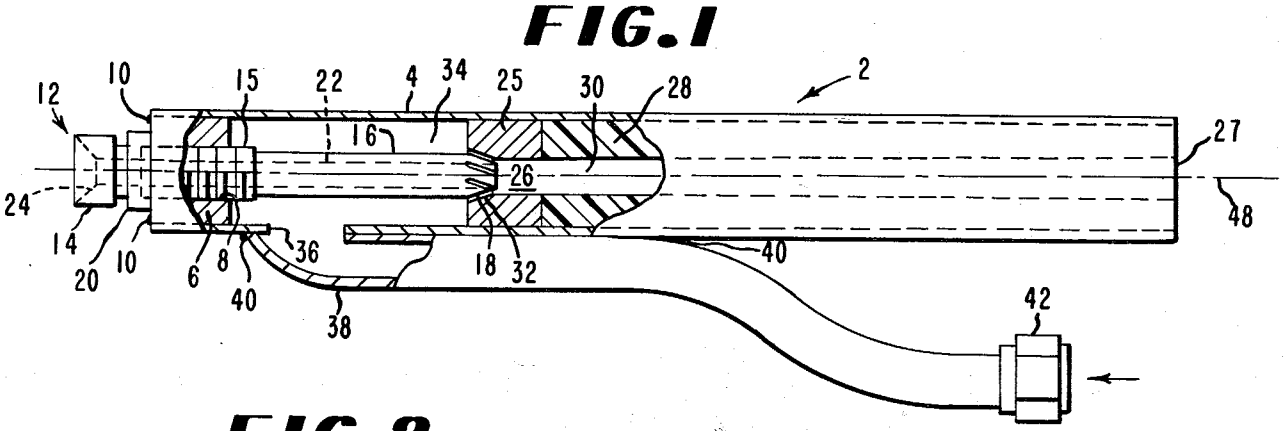
FIG. 1 shows in side elevation and partial cut-away and cross-section a yarn-handling device of the present invention.
Figure 2:
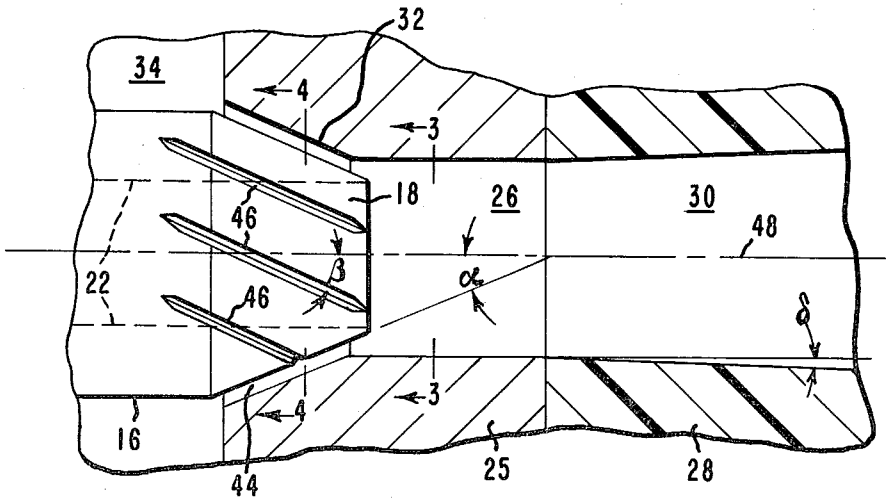
FIG. 2 shows a portion of the device of FIG. 1 in enlargement.
Figure 3:
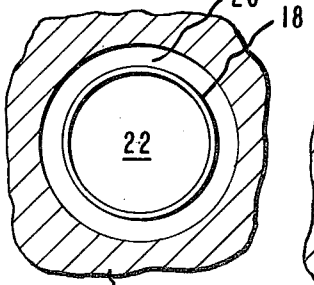
FIG. 3 is a cross-section taken along line 3—3 of FIG. 2.
Figure 4:
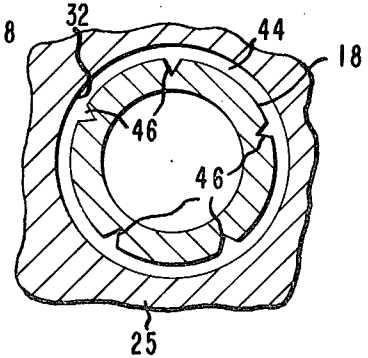
FIG. 4 is a cross-section taken along line 4—4 of FIG. 2.

An embodiment of one form of the yarn-handling device of the present invention is shown in FIG. 1, along with additional details in FIGS. 2, 3 and 4. The device is of a size that can be handled with one hand by an operator for operations such as stripping, doffing or string-up of yarn.

The yarn-handling device 2 comprises: a housing 4 containing an interior chamber 34 having an inlet 36 for pressurized air; a yarn inlet tube 12 having an inlet end 14, an internal passage 22 and an outlet end; a yarn outlet tube having an inlet end in plug 25, an internal passage 26, 30 and an outlet end 27; and an annular passage 44 connecting interior chamber 34 with inlet end of the yarn outlet tube.

A plug 6 having a threaded axial passage 8 is mounted within one end of the tubular housing 4 by weld bead 10.

The yarn inlet tube 12 consists of a nozzle 14 at the inlet end, a threaded shank 15 intermediate the ends of the yarn inlet tube, and a shank 16 of smaller diameter extending from the threaded shank and terminating in a frusto-conical surface 18 tapering inwardly in the downstream direction of the yarn-handling device. The nozzle 14 shown in FIG. 1 is rather short in length as would be used for stripping yarn; for doffing or string-up operation, the nozzle would be several times longer (extending from the housing) than shown in FIG. 1. The smaller diameter of shank 16 enables the frusto-conical end of the nozzle element to be inserted into the passage 8 of plug 6 and then be threadably engaged therewith via shank 15 and locked into place by lock nut 20 tightened against plug 6.

The yarn inlet tube 12 has a longitudinal internal passage 22. The entrance to inlet tube 12 consists of a flared region 24 to assist yarn to enter the passage 22.

A plug 25 is press fit into the housing 4 intermediate its ends. The plug, which forms the inlet end to the yarn outlet tube, has a passage 26 in axial alignment with the passage 22. Downstream of plug 25 is positioned a cylindrical insert 28 having a bore 30 which forms a smooth continuation of passage 26 of plug 25. Bore 30 and passage 26 form the internal passage of the yarn outlet tube. The plug 25 has a frusto-conical surface 32 which terminates at the inlet to outlet passage 26, 30. The bore 30 tapers outwardly slightly in the downstream direction and this outward taper begins at the intersection between the exit of plug 25 and bore 30.

The space between plugs 6 and 25 forms a chamber 34 in the interior of the housing 4. An inlet 36 is provided in the housing. A tube 38 for supplying pressurized air to chamber 34 has an opening in register with inlet 36 and is mounted by weld beads 40 to the housing. A swagelock nut 42 is provided for connecting this tube to a source of pressurized fluid (not shown).

As best shown in FIGS. 2 and 4, the frusto-conical surfaces 18 and 32 are located in series on the same longitudinal axis 48 in almost nested relationship but are spaced apart to form an annular space 44 which connects chamber 34 and passage 26. The diameter of passage 26 is larger than yarn inlet passage 22; generally at least 1.15 times larger, but no more than 1.4 times larger.

Frusto-conical surface 18, located on the outer surface of the outlet end of the yarn inlet tube, is provided with five or six flutes 46, which are substantially evenly spaced around the surface and are inclined at an angle $\beta$ to the slant height of the surface. Preferably, flutes 46 are substantially straight cuts made into the conical surface, such as by a milling machine. The flutes extend over the entire length of the frusto-conical surface but do not enter the passage 22 to disturb its smooth circular bore. The details of flutes 46 in surface 18 are best shown in FIGS. 2 to 4. The flutes, being inclined to the slant height of frusto-conical surface 18 (see angle $\beta$ of FIG. 2), apparently provide some vorticity to the air as it passes through annular space 44.

The yarn-handling device of the invention is made of metal for durability, except for cylindrical insert 28 which is made of plastic such as epoxy resin for noise reduction purposes.

In operation, pressurized air is introduced into chamber 34 via tube 38. The configuration and direction of the frusto-conical surfaces causes the air to flow through the annular space 44 and then out passage 26 and bore 30. The constriction of the space for the air in passing through the annular space 44 causes the velocity of the fluid to increase, which in turn reduces the pressure at the opening of passage 22 and causes a suction in passage 22 which draws (aspirates) yarn into nozzle 14, along passage 22 and into contact with the air in passage 26 and bore 30 where the air carries the yarn through the remainder of the outlet tube. The dimensions of annular space 44 can be adjusted to a limited degree by threading the yarn inlet tube 12 inwardly or outwardly with respect to the housing 4, which serves to regulate the amount of suction for a given air pressure.

In accordance with the present invention, the angle of taper ($\alpha$) of the frusto-conical surfaces 18 and 32 with the longitudinal axis 48 of the passage 22 (and passage 26 and bore 30) is critical and should be from 22° to 32° and preferably from 24° to 28°. Preferably, each surface has the same taper. The angle ($\beta$) of the flutes 46 to the longitudinal axis 48 is also critical and should be from 20° to 40° and preferably from 25° to 35°.

When the taper angle ($\alpha$) and flute angle ($\beta$) are as set forth above, the amount of suction (vacuum power) is maximized at a minimum air consumption and at a minimum noise level, as will be shown hereinafter. The significance of taper angle (angle $\delta$) shown in FIG. 2, i.e. angle between the passage sidewall and a line intersecting therewith which is parallel to longitudinal axis 48, will also be shown hereinafter.

Figure 5:
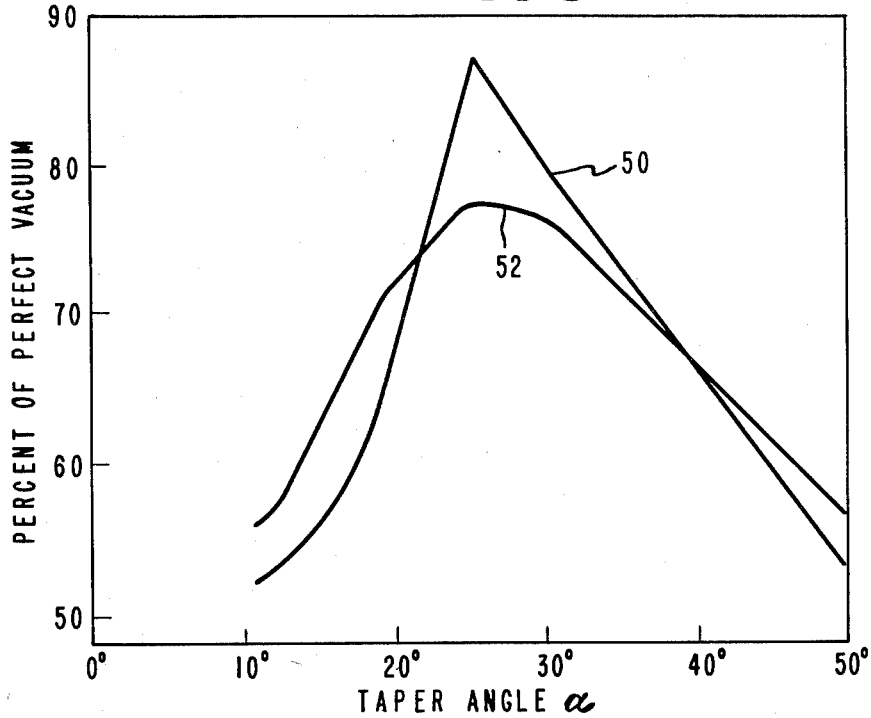
FIG. 5 is a graph showing the variation in vacuum power with angle of taper of the frusto-conical surfaces in a yarn-handling device in comparison with the same yarn handling device but with flutes omitted.

A yarn-handling device similar to that depicted in FIG. 1 was equipped with a nozzle element and plug having matching frusto-conical surfaces of different taper angles ($\alpha$) and tested for vacuum power at the nozzle. Air at a pressure of 5.6 kg/cm$^2$ gage was fed to the chamber of the device. Outlet passage 26, 30 was 0.754 cm in minimum diameter and yarn inlet passage 22 was 0.546 cm in diameter, the ratio in diameters being 1:1.38. The yarn outlet passage 30 had an angle of taper ($\delta$) of 0°27′ and was 14.9 cm long. In one embodiment of the device tested, there were five flutes in the frusto-conical surface 18 at a 30° angle ($\beta$) in the outer surface of the exit end of the yarn inlet tube. FIG. 5 shows two curves, curve 50 representing the performance of a device in which the frusto-conical surface contained flutes and curve 52 representing the same device without the flutes. Both curves show an increase in vacuum power (expressed as a percent of perfect vacuum) with increasing angle of taper up to about 25° taper angle and then a progressive decrease in vacuum power upon further increase in taper angle. This shows the criticality of taper angle for the frusto-conical surfaces in the yarn handling device.

The highest vacuum power exhibited in FIG. 5 was by the device in which the flutes were present. This shows the importance of the flutes in the frusto-conical surface at the outlet end of the yarn inlet tube.

Vacuum power is a measure of the suction power exerted on the yarn to aspirate it into and then through the yarn-handling device. The higher the vacuum power, the greater the suction power. Thus, the yarn-handling device of the present invention exhibits a greater suction power than a comparable yarn-handling device with no flutes. Such a device, having a 20° taper angle ($\alpha$) for the frusto-conical surfaces and no flutes therein, a 0°42′ taper angle ($\delta$) and 7.6-cm length for the yarn outlet passage has been used commercially heretofore. A yarn-handling device of the present invention similar to that tested for the data for curve 50 in FIG. 5 and having a 25° taper angle ($\alpha$) for the frusto-conical surface exhibited a vacuum power 80, 83, 84 and 87% at 3.5, 4.2, 4.9 and 5.6 kg/cm$^2$ air pressure, respectively, as compared to 45, 58, 80 and 83% for the corresponding pressures for the aforesaid commercially-used device.

The higher vacuum power developed for the yarn-handling device of the present invention, translates into more efficient operation for the yarn-handling device. The increase in vacuum power is obtained without any increase in air consumption. If the increase in vacuum power is not required for a particular operation, then air consumption can be reduced and energy saved thereby.

Figure 6:
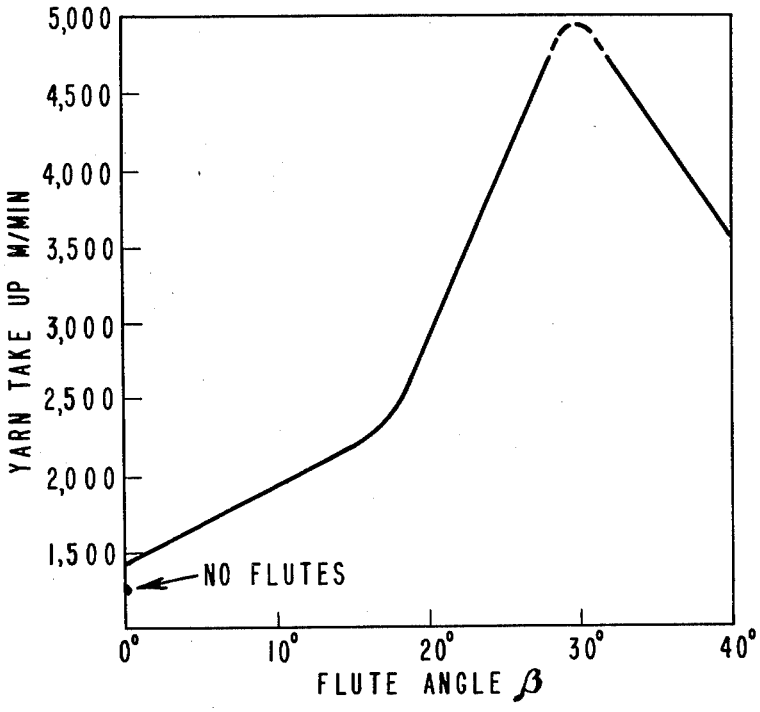
FIG. 6 is a graph showing the variation in speed of yarn take-up with angle of flutes in a yarn handling device.

Instead of measuring the advantage of the yarn-handling device of the present invention in terms of vacuum power, the advantage can also be measured as a direct effect of the device on yarn. FIG. 6 shows the kind of measurement, as well as the criticality of the angle $\beta$ of the flutes of the device. As shown in FIG. 6, the rate of yarn take-up (wind-up speed) increases sharply with increasing flute angle to a maximum at 30° angle, where the yarn take-up exceeds 4570 meters per minute (exact speed not measured). At higher flute angles, the yarn take-up decreases. The taper angle of the frusto-conical surfaces in this series of measurements was 25°, five flutes were present and the air pressure supply was 5.6 kg/cm$^2$ gage.

Figure 7:
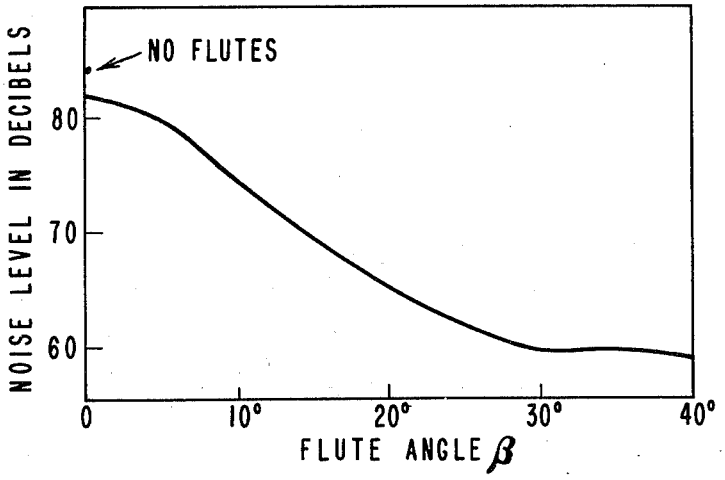
FIG. 7 is a graph showing the variation in noise level with angle of flutes.

FIG. 7 shows the effect of flute angle $\beta$ on the noise emitted by the yarn-handling device. Note that the presence of the flutes at the proper angle produces a marked decrease in noise from 82 db at 0° to 60 db for flutes at a 30° angle, when the device is operated at 5.6 kg/cm$^2$ gage.

Figure 8:
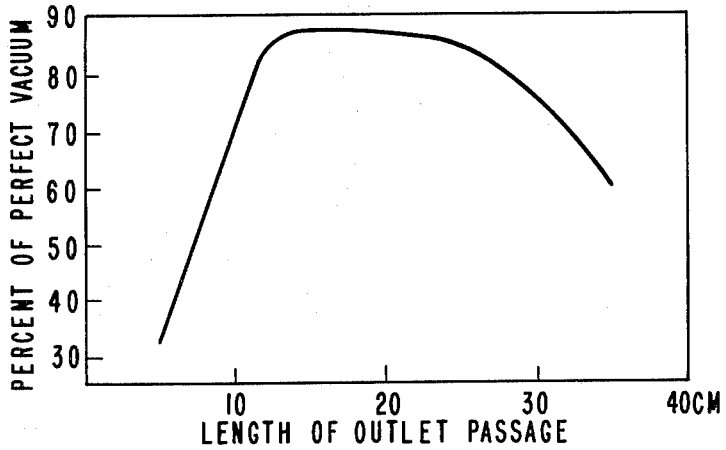
FIG. 8 is a graph showing the variation of vacuum power with length of the outlet passage.

The outlet passage also plays a significant part in efficiency of operation of the yarn-handling device. FIG. 8 shows the effect of the length of an outlet passage having a taper angle of 0°27′ on the percent of perfect vacuum achieved. Note that as the passage gets longer, the vacuum power increases to a maximum at a passage length of between 12 and 25 cm and that at greater lengths, the vacuum power decreases. Yarn handling devices of the present invention, generally have an outlet passage length of at least 10 cm and the passage should not be longer than 30 cm, preferably between 12 and 25 cm.

Figure 9:
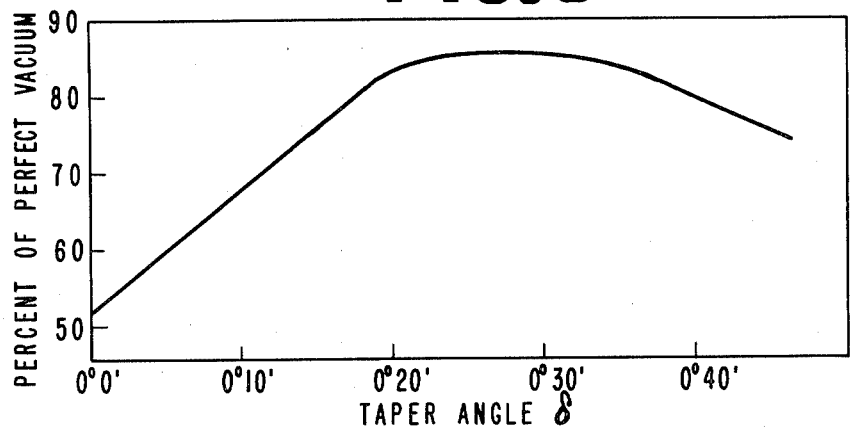
FIG. 9 is a graph showing the variation of vacuum power with taper of the outlet passage.

FIG. 9 shows the benefit of a very small taper to the outlet passage. Note that vacuum power increases with taper angle to a maximum in the range of 0°24′ to 0°32′ at a length of 15.2 cm for the outlet passage. Generally, yarn handling devices of the present invention have a taper angle of 0°15′ to 0°50′ for the outlet passage, with taper angles of about 0°20′ to 0°35′ being preferred.

I claim:

1. In a yarn-handling device of the type which includes a housing having an interior chamber, an inlet for supplying pressurized air to the chamber, a yarn inlet tube having an inlet end, an internal passage and an outlet end, a yarn outlet tube having an inlet end, an internal passage and an outlet end, both tubes being located in series on the same longitudinal axis of the device, and structure defining an exit from the chamber for directing air from the chamber into the inlet end of the outlet tube and in so doing creating a suction effect for aspirating yarn into and through the inlet tube and then into, through and out of the outlet tube with the flow of air, the structure including a first frusto-conical surface forming the exit from the chamber, a second frusto-conical surface located on the outer surface of the outlet end of the yarn inlet tube, the first and second frusto-conical surfaces being spaced from one another in coaxial, almost nested relationship to form an annular passage through which air flows from the chamber into the inlet end of the yarn outlet tube, the improvement comprising the angle of taper of said frusto-conical surfaces being between 22° and 32° to the longitudinal axis, the secondmentioned frusto-conical surface having a slant height and a plurality of flutes evenly spaced around the surface, the flutes being inclined at an angle of 20° to 40° to the slant height and the internal passage of the outlet tube being from 10 to 30 cm long and the passage tapering outwardly in the downstream direction at an angle of from 0°15′ to 0°50′, as measured from the longitudinal axis.

2. The device of claim 1 wherein the angle of taper of the frusto-conical surfaces is between 24° and 28°.

3. The device of claim 2 wherein the angle of taper of the frusto-conical surfaces are equal to each other.

4. The device of claim 1 wherein the angle of the flutes is between 25° and 35°.

5. The device of claim 1 wherein the internal passage of the outlet tube is between 15 and 25 cm long.

6. The device of claim 1 wherein the angle of taper of the outlet passage is between 0°20′ and 0°35′.

7. The device of claim 1 wherein the internal passage of the yarn outlet tube has a mimimum diameter that is between 1.15 and 1.4 times the diameter of the internal passage of the yarn inlet tube.

* * * * *